US006389653B1

(12) United States Patent
Matoba

(10) Patent No.: US 6,389,653 B1
(45) Date of Patent: May 21, 2002

(54) BELT END FASTENER

(75) Inventor: Hiroshi Matoba, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/008,562

(22) Filed: Jan. 16, 1998

(30) Foreign Application Priority Data

Jan. 16, 1997 (JP) ..... 9-005597

(51) Int. Cl.[7] ..... A44B 11/25

(52) U.S. Cl. ..... 24/265 BC; 24/615; 24/616; 24/265 AL; 24/265 CD

(58) Field of Search ..... 24/265 BC, 265 AL, 24/265 CD, 2.5, 701, 666, 706.1, 616, 615

(56) References Cited

U.S. PATENT DOCUMENTS

| | | | | | |
|---|---|---|---|---|---|
| 1,477,597 | A | * | 12/1923 | Schneider | 24/616 |
| 1,737,246 | A | * | 11/1929 | Jones | 24/616 |
| 2,458,287 | A | * | 1/1949 | Moon | 24/265 CD |
| 2,964,937 | A | * | 12/1960 | Lautin | 24/616 |
| 4,825,515 | A | | 5/1989 | Wolterstorff, Jr. | |
| 4,949,436 | A | * | 8/1990 | Anscher | 24/616 |
| 5,309,610 | A | * | 5/1994 | Legal | 24/615 |
| 5,440,792 | A | * | 8/1995 | Ida | |
| 5,485,658 | A | * | 1/1996 | Fildan | 24/666 |

FOREIGN PATENT DOCUMENTS

| | | | | |
|---|---|---|---|---|
| DE | 257432 | | 3/1913 | |
| FR | 425197 | | 6/1911 | |
| FR | 1128175 | * | 1/1957 | 24/616 |
| GB | 697877 | | 9/1953 | |

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

A belt end fastener comprises a flatted tubular socket, and a plug to be detachably inserted in the socket. The plug has a plate-like tongue, and a ring projecting from a base of the plug, the tongue having a pair of belt-insertion holes Also the plug has a frame around the tongue, and a pair of resilient locking projections for locking engagement with opposite side walls of the socket when the plug is inserted in the socket. In use, one end of a belt of a bag or other article is inserted through the socket and the belt-insertion holes and is then turned over and is tentatively held in such folded form, whereupon the belt together with the plug is inserted into the socket for fastening. For unfastening the belt, the ring is pulled away from the socket while the locking projections are pressed toward each other against their resilience.

17 Claims, 10 Drawing Sheets

BELT END FASTENER

BACKGROUND OF THE INVENTION

1. Field of the Invention

This invention relates to a belt fastener for use in a belt of a rucksack, a shoulder bag, etc. or a belt of a garment or for use in a flat woven or knit belt and in order to prevent fraying of the belt end or in order to finish the belt end neatly. Also, the invention relates to a belt end fastener equipped with a belt-length adjuster or a belt stopping function.

2. Description of the Related Art

Japanese Utility Model Publication No. Hei 7-42324 discloses, as shown in FIG. 19 of the accompanying drawings, a belt 4' whose end is covered with a row of longitudinally elongated rectangular windows W molded of thermoplastic resin and arranged transversely of the belt 4'. The belt end is disposed within the successive molded window W, and opposite side edges of the belt end are disposed within opposite outermost window W.

Japanese Utility Model Publication No. Hei 3-50730 discloses, as shown in FIG. 20, a belt end fastener equipped with a belt-length adjuster. The belt end fastener is a two-member structure composed of a fastener body 3" and a wedge-shaped holder 2". The fastener body 3" has a longitudinal tunnel-like belt stop channel 140" extending beyond a base 13", a belt-insertion channel 14" disposed on either the front side or the rear side of the belt stop channel 140" and parallel to the belt stop channel 140", a frame 17" extending forward from the base 13", bridges B extending between opposite side members 7" of the frame 17", a partition wall P disposed between the belt stop channel 140" and the belt-insertion channel 14", and a pair of guide projections G projecting forward from the partition wall P and having the same thickness as the partition wall P. In use, the wedge-shaped holder 2", with one end portion of the belt 4" folded about one end of the wedge-shaped holder 2", is inserted into the belt stop channel 140" from its front end so as to clamp the belt between a large-thickness portion of the wedge-shaped holder 2" and the belt stop channel 140".

With the molded windows disclosed in the first-named publication, since they have to be molded on the belt end before the belt 4' is attached to a rucksack, a shoulder bag, etc., it is impossible to quickly exchange a molded buckle with another in response to the customer's request. As many kinds of belts with molded buckles must be previously prepared in order to meet various demands of customers, efficient stock management and improved productivity are difficult to achieve.

With the belt end fastener disclosed in the second-named publication, since belt 4" is inserted into the belt-insertion channel with its end portion merely folded about tends to slip between the wedge-shaped holder 2" and the fastener body 3" when a pulling force is exerted on the belt 4", thus causing variations in belt length. Further, since the belt 4" not tentatively fixed to the wedge-shaped holder 2", smooth and reliably insertion of the holder 2" together with the belt 4" into the fastener body 3" is hard to be achieved.

SUMMARY OF THE INVENTION

A first object of this invention is to provide a belt end fastener in which one end of a belt can be fastened in a fixed posture neatly and firmly with no exposure and can be tentatively held so as to be inserted smoothly and which can be exchanged with another in a simple manner while in use.

A second object of the invention is to provide a belt end fastener in which a plug, with one end of a belt tentatively held, can be inserted into a socket in a very simple manner and in which the belt end can be fastened stably and reliably with no skid.

A third object of the invention is to provide a belt end fastener in which a plug with one end of a belt tentatively held can be fastened firmly in a socket so as not to be accidentally removed and the plug can be inserted into the socket in a simple manner and which can be exchanged with another simply.

A fourth object of the invention is to provide a belt end fastener in which a plug is specified in shape individually so that the fastener is suitable for various applications.

A fifth object of the invention is to provide a belt end fastener in which a socket is specified in shape so that a plug can be inserted in the socket simply and reliably.

A sixth object of the invention is to provide a belt end fastener in which both a socket and a plug are specified in shape so that the plug can be inserted into the socket smoothly.

A seventh object of the invention is to provide a belt end fastener in which a socket is specified in shape so that a plug can be inserted into the socket in a very simple manner.

An eighth object of the invention is to provide a belt end fastener in which a socket is specified in shape so that the fastener is suitable for use as a male-and-female-type buckle.

A ninth object of the invention is to provide a belt end fastener which can be attached to a garment in a simple manner.

According to a first aspect of the invention, there is provided a belt end fastener comprising a flatted tubular socket and a plug to be detachably inserted in the socket. The plug has a plurality of belt-insertion transverse holes and a belt-skid-prevention portion extending at an edge of the belt-insertion transverse hole, and the plug has at one end an enlarged base.

According to a second aspect of the invention, the plug at the other end a wedge-shape tongue for holding an end of a belt in a folded form when the plug is inserted in the socket.

According to a third aspect of the invention, the plug has at opposite sides a pair of resilient locking projections for engagement with the socket.

According to a fourth aspect of the invention, the plug has a ring projecting from the base.

According to a fifth aspect of the invention, the plug has a belt-length adjuster connected to the base.

According to a sixth aspect of the invention, the belt end fastener is in a double form in which a pair of belt end fasteners have interlocking male and female coupling members projecting from respective bases of the two plugs.

According to a seventh aspect of the invention, the socket has on its plug-insertion end a ring extending from opposite side walls of the socket.

According to an eighth aspect of the invention, the ring has on opposite inner edges a pair of tapered plug-guide ribs for guiding the plug.

According to an ninth aspect of the invention, the plug has a frame having a pair of side members slidable on the plug-guide ribs and the base of the plug is formed so as to be inserted between the plug-guide ribs.

According to a tenth aspect of the invention, the socket has on its plug-insertion end a belt-length adjuster extending from opposite side walls of the socket and having on its opposite inner edges a pair of tapered plug-guide ribs.

According to an eleventh aspect of the invention, the socket has a pair of side attachment projections extending in opposite directions from its lower wall so that the socket may be attached to other article such as a bag.

DETAILED DESCRIPTION OF THE PREFERRED EMBODIMENTS

Various preferred embodiments of a belt end fastener according to this invention will now be described in detail with reference to the accompanying drawings.

Figure 1:
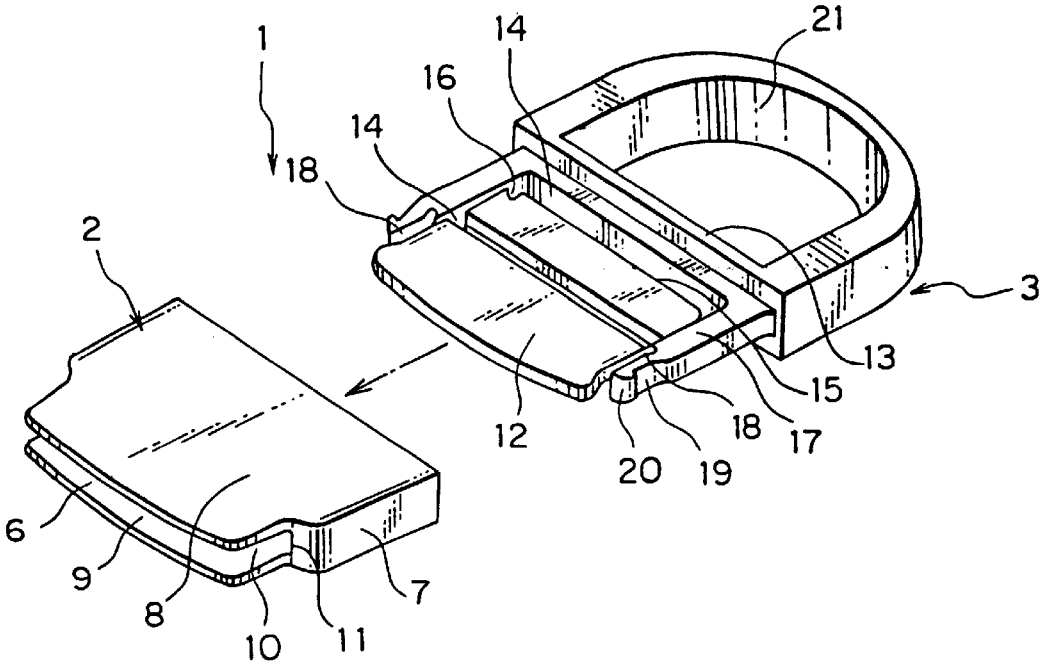
FIG. 1 is an exploded perspective view of a belt end fastener according to a first embodiment of this invention.
Figure 2:
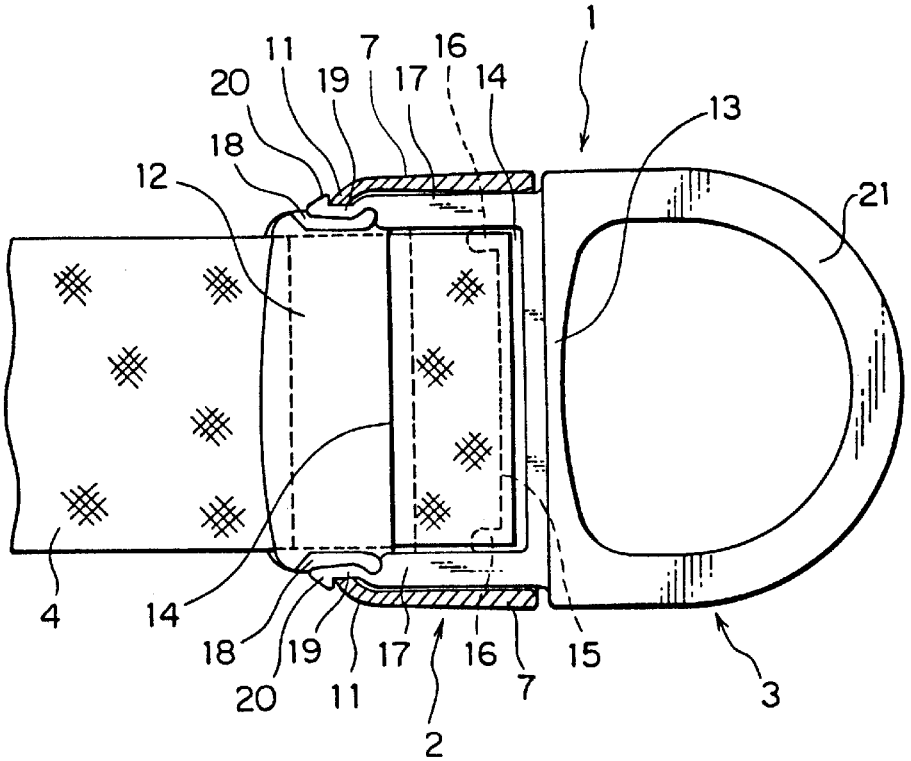
FIG. 2 is a plan view, with parts broken away, of the belt end fastener of the first embodiment, showing a socket and a plug in a coupled form.

The belt end fastener 1 of this invention is a two-member structure which is composed of a socket 2 and a plug 3 to be inserted in the socket 2, as shown in FIG. 1. Both the socket 2 and the plug 3 are formed of thermoplastic resin, such as polyamide, polyacetal, polypropylene or polybutyleneterephtalate, by injection molding or extrusion molding, or are formed of metal, such as aluminum alloy or zinc alloy, by die casting.

In the belt end fastener 1 according to a first embodiment shown in FIGS. 1 through 5, the socket 2 is in the form of a flatted tube having at one end a plug-insertion mouth 5 and at the other end a belt-insertion mouth 6. The tubular socket 2 composed of an upper plate 8, a lower plate 9, and opposite side walls 7, jointing defining a plug-accommodation chamber 10; each side wall 7 extends from the plug-insertion mouth 5 and terminates in a slightly inwardly curved engaging edge 11 short of the belt-insertion mouth 6 for locking engagement with the plug 3 in a manner described below.

The plug 3 has a plate-like tongue 12 to be inserted in the plug-accommodation chamber 10 of the socket 2, and an thick enlarged base 13 disposed at an rear end of the tongue 12. The tongue 12 has a pair of belt-insertion transverse holes 14, and an acute belt-skid-prevention portion 15 at an rear edge of a plate-like portion defined between the two transverse holes 14. Preferably, the tongue 12 also has another acute belt-skid-prevention portion 15 at an rear edge of a plate-like portion defined at a front end of the tongue 12. The plug 3 also has a side recess 16 at each side of the belt-skid-prevention portion 15 so that a belt 4 can be inserted stably. The tongue 12 may have more than two belt-insertion holes 14 as long as one end portion of the belt 4 can be directly covered with another part of the belt 4 when threaded through the belt-insertion holes 14 and folded.

The tongue 12 is surrounded all sides except the front side by thick frames 17; each of opposite side frames 17 has in its front end portion a cutout 18 to form a resilient locking projection 19 terminating in an end 20 projecting outside for locking engagement with the corresponding engaging edge 11 of the socket 2. The tongue 12 is wedged-shaped or tapered in cross section on its front side so as to be smoothly inserted in the socket 2.

The base 13 disposed at the rear end of the tongue 12 has such a shape as to close the plug-insertion mouth 5 of the socket: 2 when the tongue 12 is fully inserted into the socket 2. A grip ring 21 extends from opposite side ends of the base 13 so that the plug 3 can be easily inserted into and removed from the socket 2 by using the ring 21.

Figure 3:
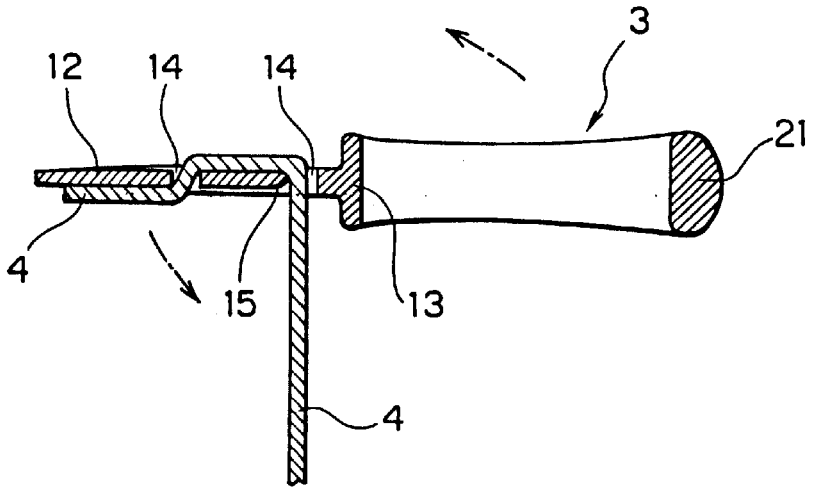
FIG. 3 is a fragmentary longitudinal cross-sectional view of the belt end fastener of the first embodiment, showing one end portion of a belt threaded through the plug.
Figure 4:
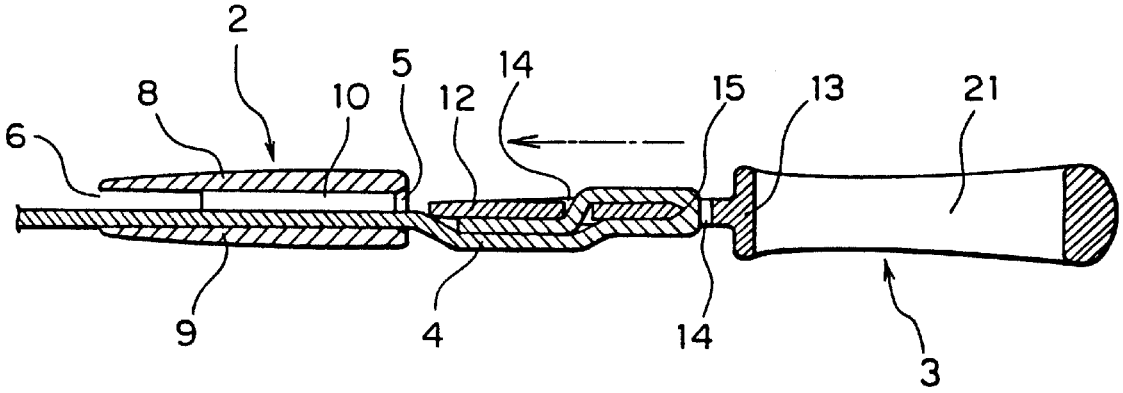
FIG. 4 is a longitudinal cross-sectional view of the belt end fastener of the first embodiment, showing the belt inserted through the socket with one end portion of the belt threaded through the plug.
Figure 5:
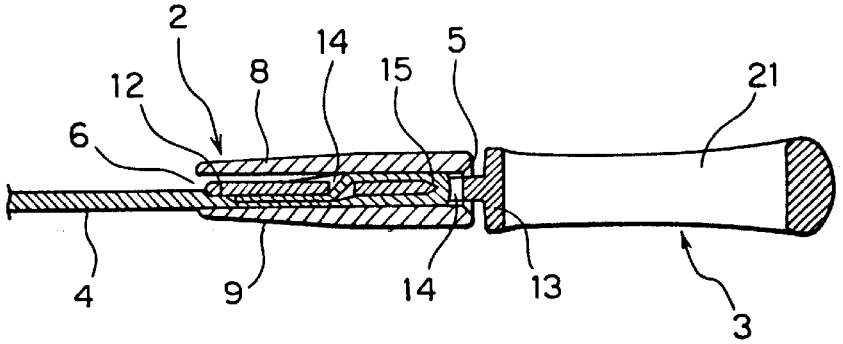
FIG. 5 is a longitudinal cross-sectional view of the belt end fastener of the first embodiment, showing the plug and the socket coupled together to fasten the belt.

In use, one end portion of the belt 4 threaded through the plug-accommodation chamber 10 of the socket 2 is threaded through the rear belt-insertion transverse hole 14 of the tongue 12 and then through the front belt-insertion transverse hole 14 as shown in FIG. 3, whereupon the plug 3 is angularly moved in the direction indicated by arrows in FIG. 3 to fold the belt 4 so that the end portion of the belt 4 is cramped between another part of the belt 4 and the tongue 12 as shown in FIG. 4. With the belt end portion tentatively held in folded form, the tongue 12 is inserted into the plug-accommodation chamber 10 of the socket 2 in the direction indicated by an arrow in FIG. 4, firmly clamping the belt 4 between the tongue 12 and the lower plate 9 of the socket 2 as shown in FIG. 5. During this inserting, the locking projections 19 of the tongue 12 are inserted into the socket 2 as resiliently bent by the opposite side walls 7 of the socket 2 until their ends 20 come into locking engagement with the engaging edges 11 of the opposite side walls 7 so that the plug 3 is prevented from being accidentally removed from the socket 2.

Figure 6:
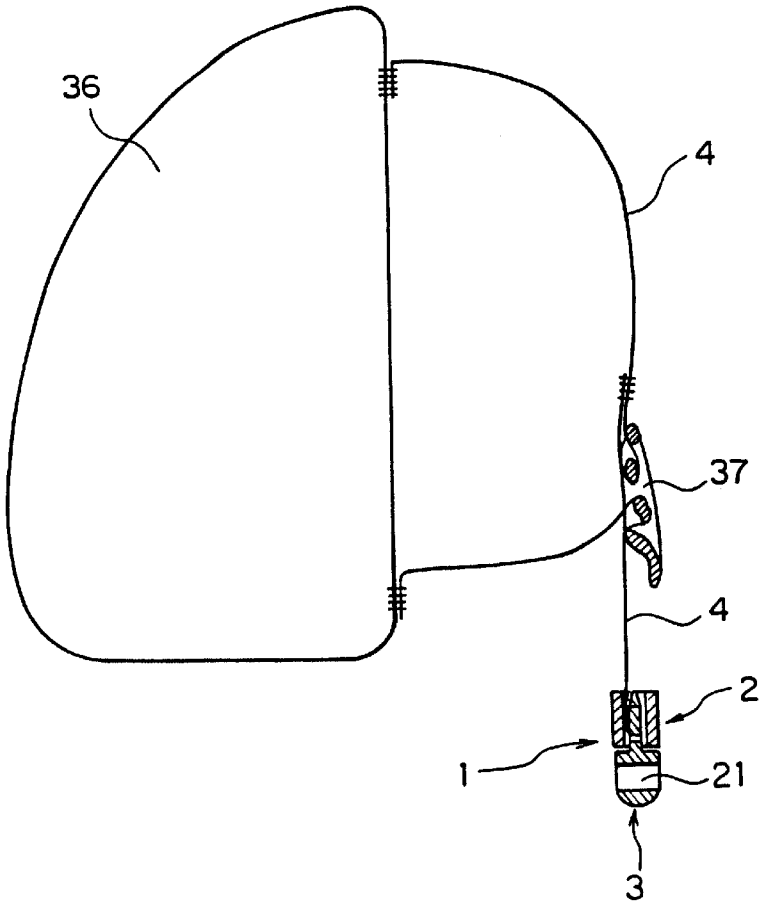
FIG. 6 is a view showing a rucksack in which the belt end fastener of the invention is used.

For removing the plug 3 from the socket 2, the ends 20 of the locking projections 19 are pressed toward each other inwardly of the side walls 7 and, at the same time, the ring 21 of the plug 3 is pulled away from the socket 2 by the finger. The belt end fastener 1 may be used on one end portion of a belt 4 as of a rucksack 36 of FIG. 6, the length of the belt 4 being adjustable by a belt-length adjuster 37.

Figure 7:
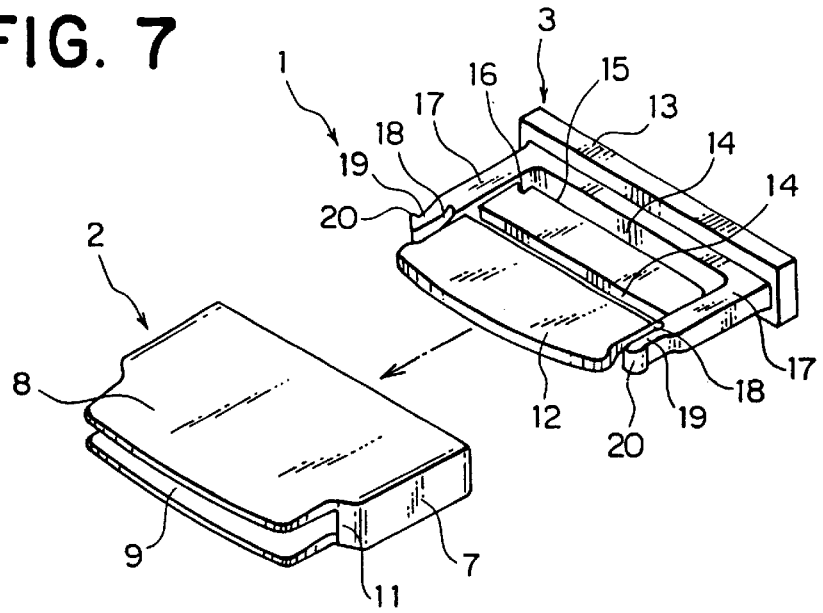
FIG. 7 is an exploded perspective view of a belt end fastener according to a second embodiment.
Figure 8:
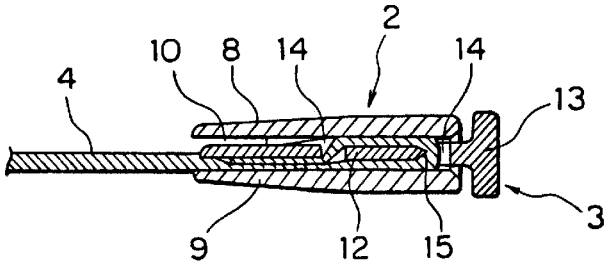
FIG. 8 is a longitudinal cross-sectional view of the belt end fastener of the second embodiment, showing a plug and a socket coupled together to fasten one end portion of a belt.
Figure 9:
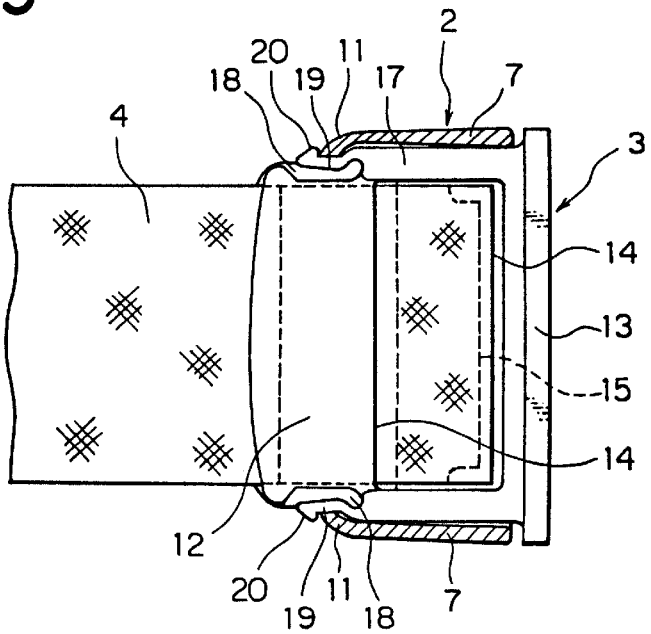
FIG. 9 is a plan view, with parts broken away, of the belt end fastener of the second embodiment.

FIGS. 7 through 9 show a belt end fastener 1 according to a second embodiment in which both the socket 2 and the tongue 12 of the plug 3 are identical in shape with those of the first embodiment except that the base 13 disposed at an rear end of the tongue 12 is devoid of any ring. In use, with a belt 4 threaded through the socket 2 and through plug 3 in the same manner as the previous embodiment, the base 13 is pushed to insert the tongue 12 into the socket 2 until the ends 20 of the locking projections 19 of the plug 3 come into locking engagement with the respective engaging edges 11 of the opposite side walls 7 of the socket 2. For removing the tongue 12 from the socket 2, the ends 20 of the locking projections 19 of the plug 3 are pressed toward each other and, at the same time, the base 13 is pulled away from the socket 2 by gripping.

Figure 10:
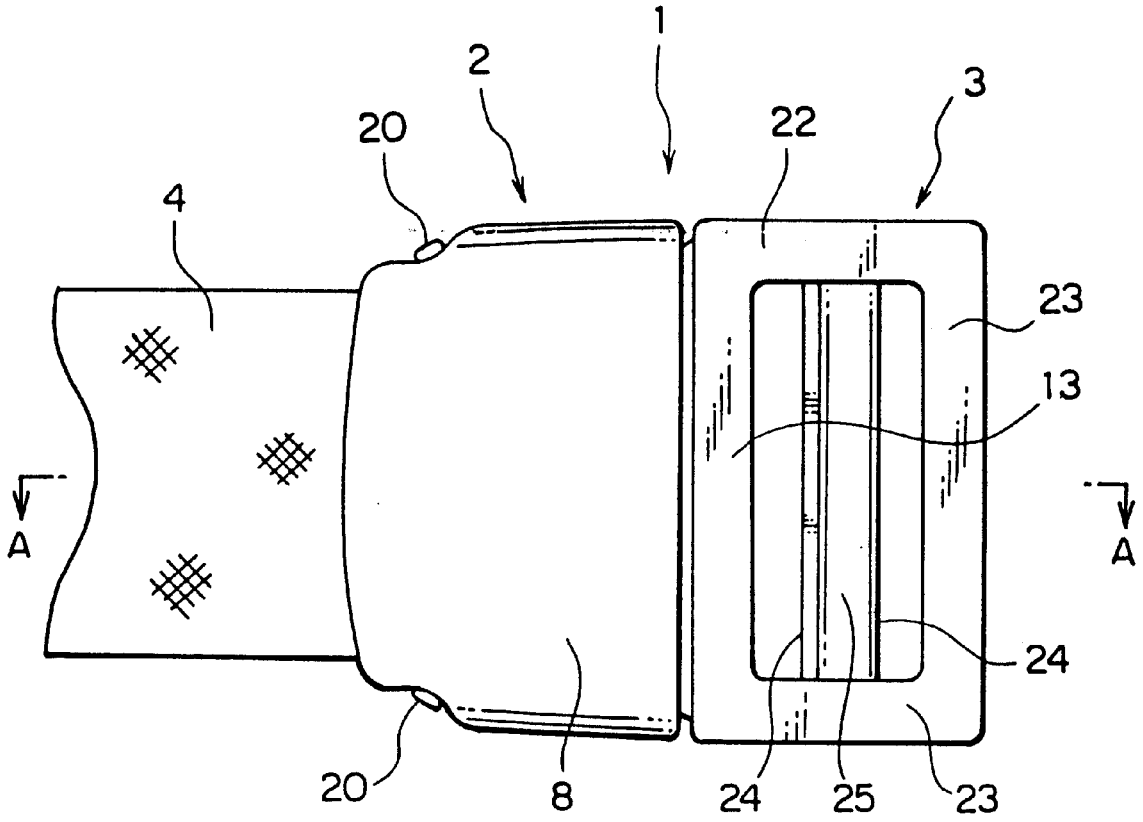
FIG. 10 is a plan view of a belt end fastener according to a third embodiment, showing a plug and a socket coupled together to fastener one end portion of a belt.
Figure 11:
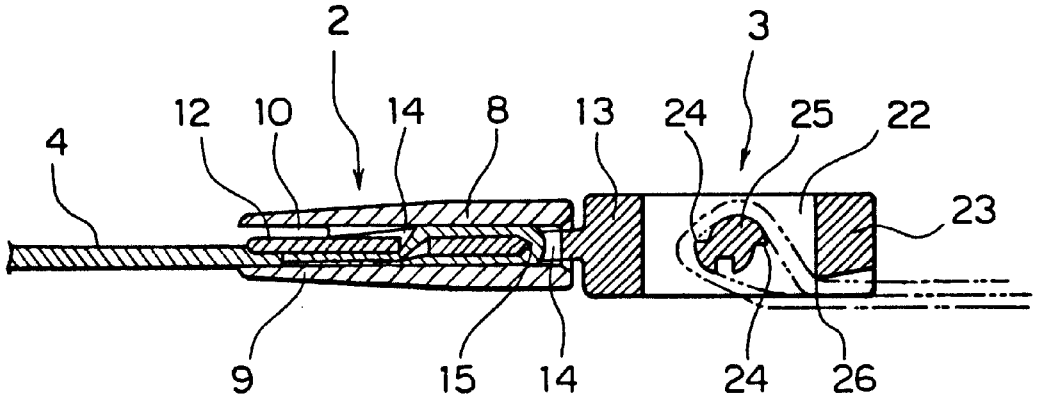
FIG. 11 is a cross-sectional view taken along line A—A of FIG. 10.

FIGS. 10 and 11 show a belt end fastener 1 according to a third embodiment in which both the socket 2 and the tongue 12 of the plug 3 are identical in shape with those of each of the previous embodiments except that the base 13 has a belt-length adjuster 22. The belt-length adjuster 22 is composed of a generally C-shaped frame 23 equal in thickness to the base 13 and projecting from the base 13, a central belt-turnover bar 25 extending between opposite side frame members of the frame 23 and having front and rear belt-skid-prevention projections 24, and an engaging corner 26 formed on the lower end of a rear frame member of the frame 23. The belt 4 is wound around the belt-turnover bar 25 and is frictionally held in overlapped form by the engaging corner 26.

Figure 12:
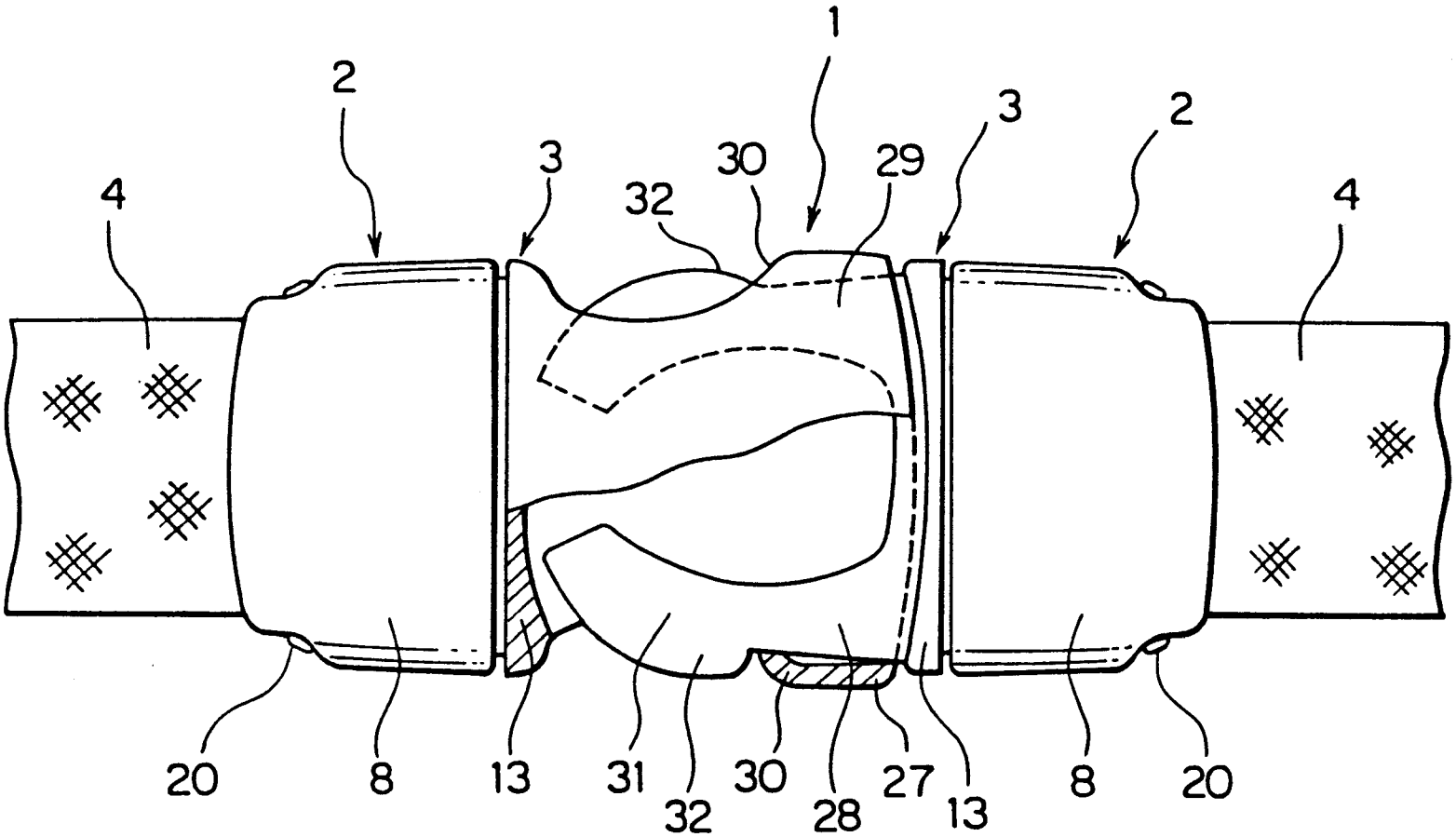
FIG. 12 is a plan view, with parts broken away, of a belt end fastener according to a fourth embodiment.

FIG. 12 shows a belt end fastener 1 according to a fourth embodiment in which the belt end fastener 1 is a double form composed of male and female fasteners 1. In each of the male and female fasteners 1, both the socket 2 and the tongue 12 of the plug 3 are identical in shape with those of each of the previous embodiments except that the male fastener 1 has a male coupling member 28 and the female coupling member 27 interengageable with the male coupling member 28. The female coupling member 27 is in the form of a flatted tube 29 projecting from the base 13 of a plug 3 of the female fastener 1 and having on opposite side walles a pair of inwardly curved engaging edges 30. The male coupling member 28 is in the form of a bifurcated resilient projection 31 extending from the base 13 of the tongue 12 of the other plug 3 and having at opposite outer sides a pair of engaging projections 32 engageable with the respective engaging edges 30 of the tube 29.

Figure 13:
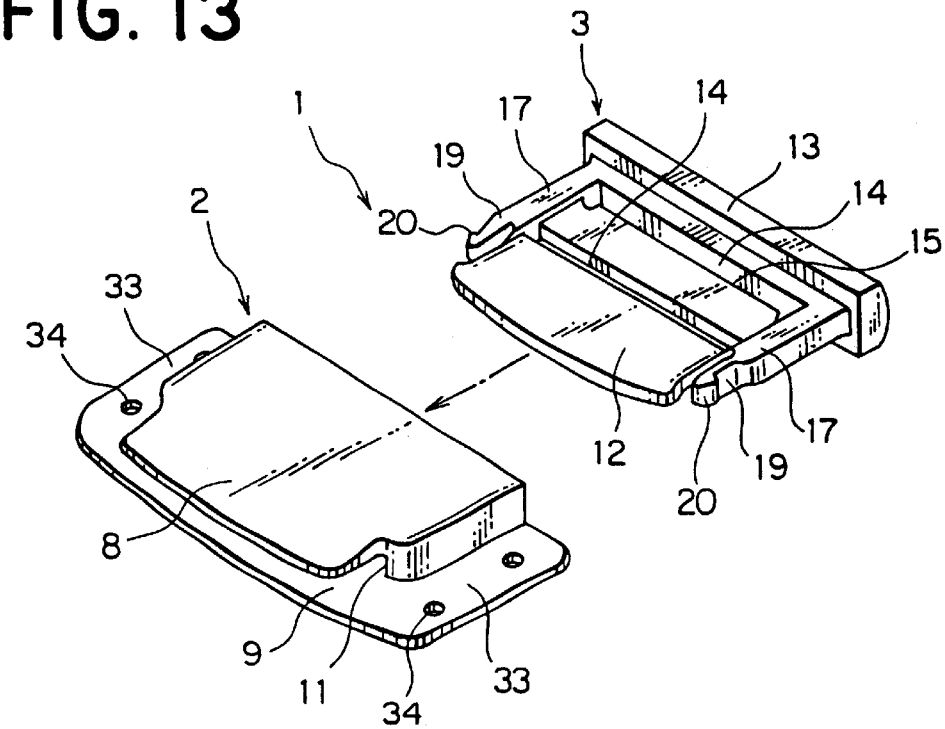
FIG. 13 is an exploded perspective view of a belt end fastener according to a fifth embodiment.

FIG. 13 shows a belt end fastener 1 according to a fifth embodiment in which both the socket 2 and the plug 3 are identical in shape with those of the fastener of FIG. 7 except that the socket 2 has a pair of side projections 33 extending in opposite directions from the lower plate 9 and each having a plurality of attachment holes 34 so that the socket 2 can be attached to an article, such as a rucksack or a shoulder bag. In each of the previous embodiments, the socket 2 may have the attachment side projections 33 like this embodiment.

Figure 14:
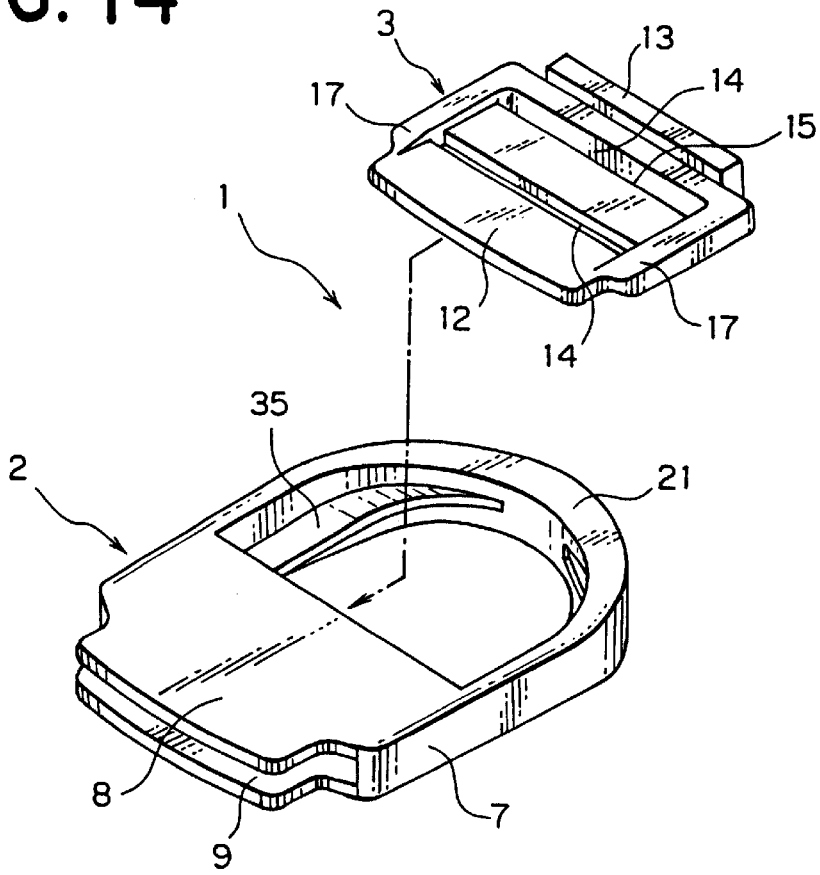
FIG. 14 is an exploded perspective view of a belt end fastener according to a sixth embodiment.
Figure 15:
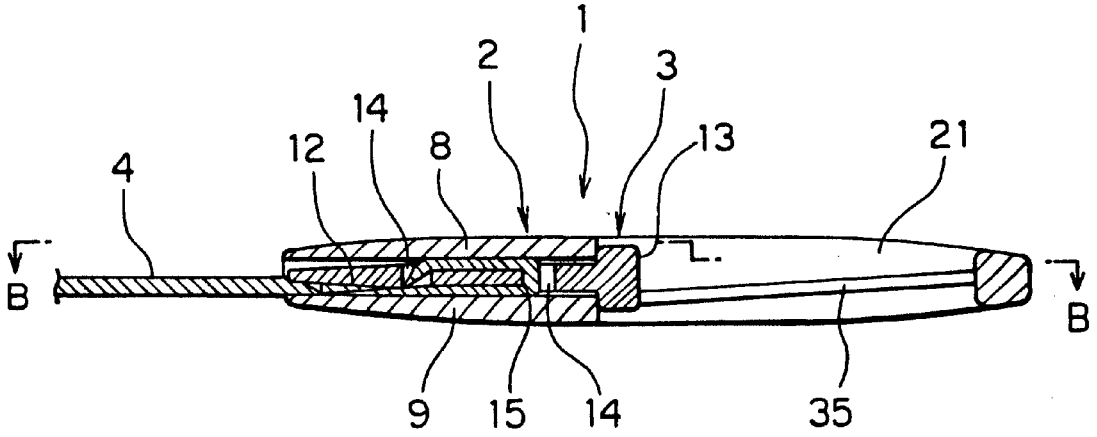
FIG. 15 is a longitudinal cross-sectional view of the belt end fastener of the sixth embodiment showing a plug and a socket coupled together to fasten one end portion of a belt.
Figure 16:
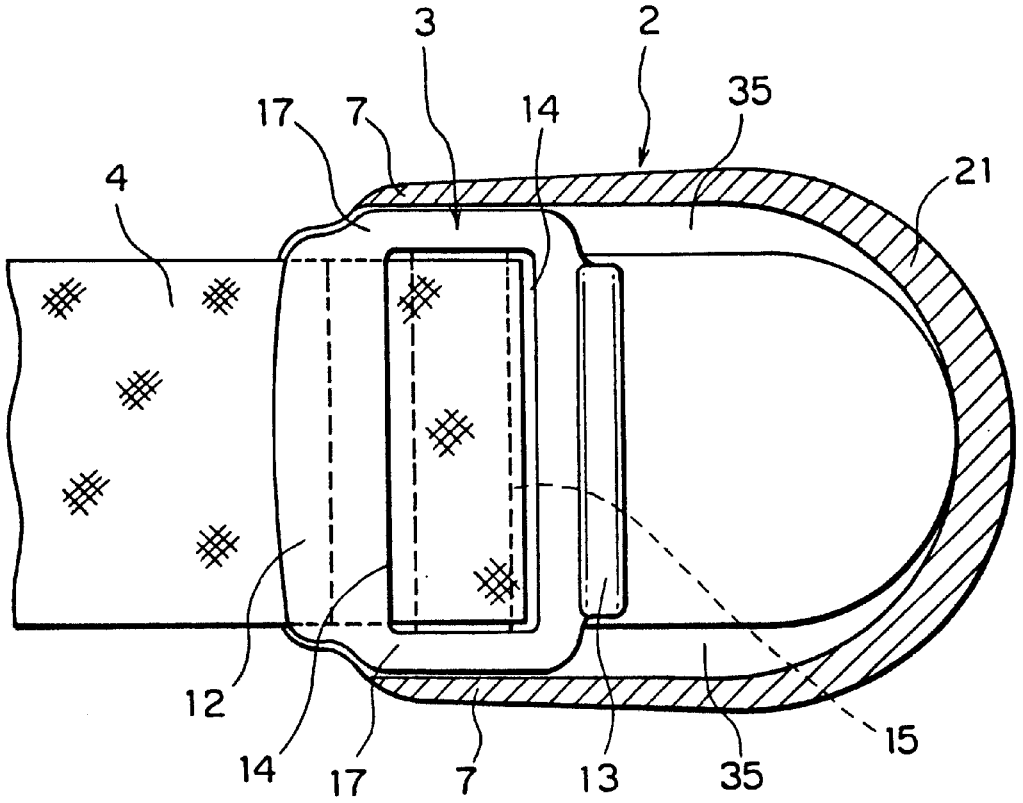
FIG. 16 is a cross-sectional view taken along line B—B of FIG. 15.

FIGS. 14 through 16 show a belt end fastener 1 according to a sixth embodiment which is identical in structure with each of the previous embodiments in principle but include some modifications as follows. The socket 2 has at its plug-insertion mouth 5 a grip ring 21 projecting from opposite sidewalls 7 and having on its opposite inner edges a pair of tapered plug-guide ribs 35. The plug 3 has a pair of belt-insertion holes 14 extending transverse in a tongue 12, and a belt-skid-prevention portion 15 extending at a rear edge of a plate-like portion defined between the belt-insertion holes 14. The tongue 12 has a generally C-shaped frame 17 composed of a pair of straight side frame members and a rear-end frame member extending between the side frame members, and EL base 13 projecting from the rear-end frame member.

In use, with the belt 4 is threaded through the tongue 12, the plug 3 is inserted into the socket 2 as the front ends of the side frame members of the frame 17 are guided along the plug-guide ribs 35 as shown in FIGS. 15 and L6. Whereupon, the plug 3 is firmly secured to the socket 2 by friction under the tension of the belt 4. For removing the plug 3 from the socket 2, the base 13 is pulled away from the socket 2 by gripping.

Figure 17:
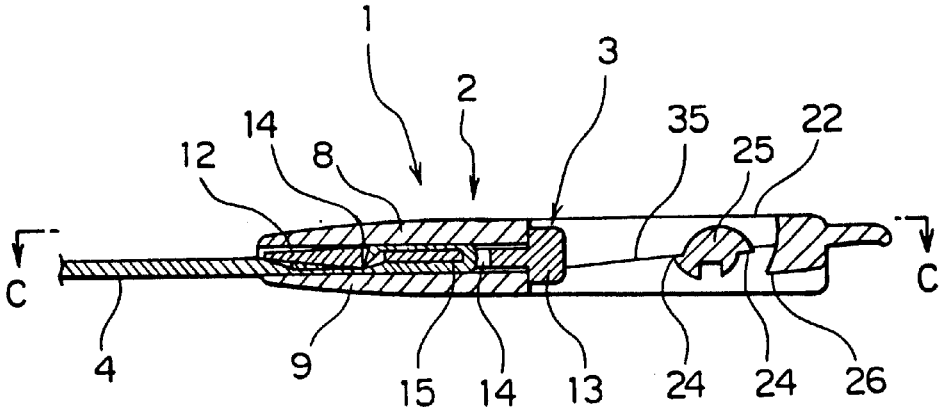
FIG. 17 is a longitudinal cross-sectional view of a belt end fastener according to a seventh embodiment showing a plug and a socket coupled together to fasten one end portion of a belt.
Figure 18:
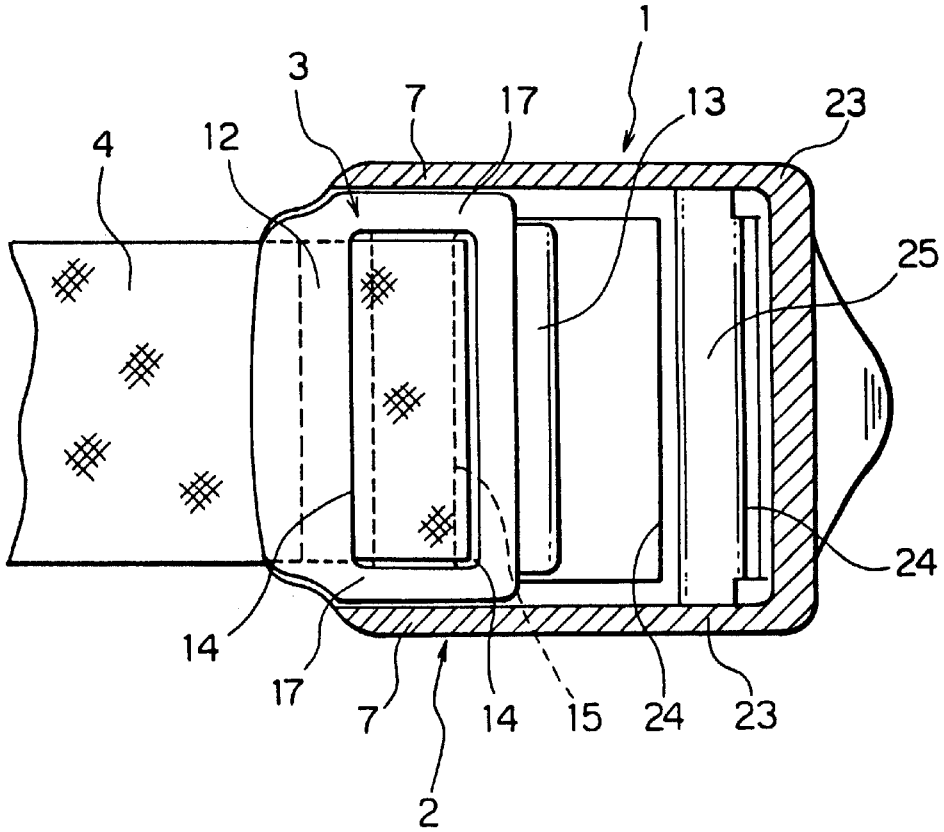
FIG. 18 is a cross-sectional view taken along line C—C of FIG. 17.
Figure 19:
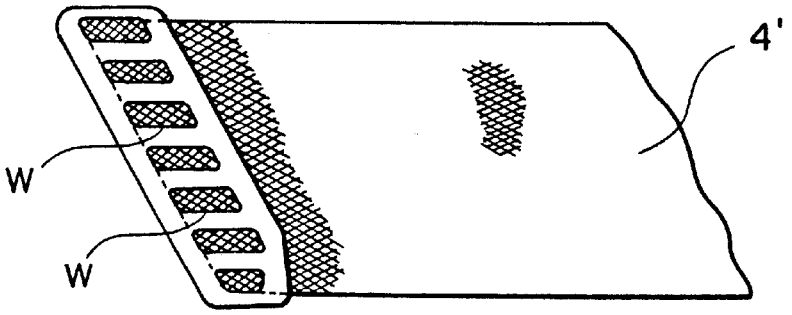
FIG. 19 PRIOR ART
FIG. 19 is a fragmentary plan view showing a belt with a conventional molded product mounted on one end of the belt.
Figure 20:
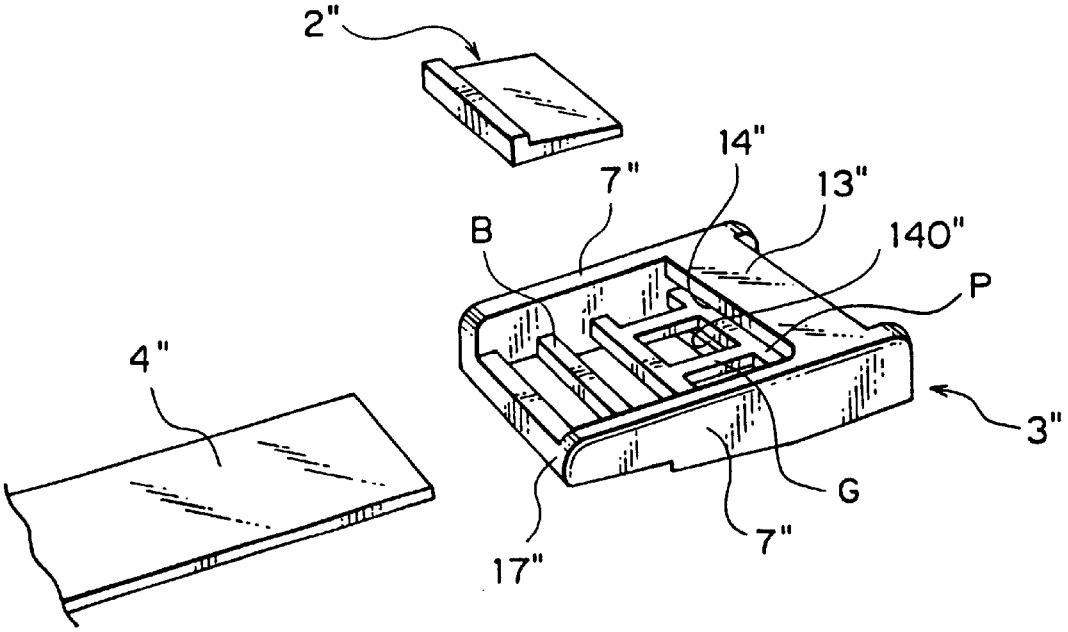
FIG. 20 PRIOR ART
FIG. 20 is an exploded perspective view of a conventional belt end fastener.

FIGS. 17 and 18 show a belt end fastener 1 according to a seventh embodiment which is identical in structure with the sixth embodiment except that the socket 2 has a unique shape such that another belt can be attached to the socket 2.

For this purpose, the socket 2 has a belt-length adjuster 22 projecting in the direction opposite to the plug insertion direction. The belt-length adjuster 22 is composed of a generally C-shaped frame 23 composed of a pair of straight side frame members extending longitudinally from opposite side walls 7 and a straight rear-end frame member extending between the two side frame members, a central belt-turnover bar 25 extending transversely between the two side frame members and having front and rear belt-skid-prevention projections 24, and an engaging corner 26 formed on a lower end of the rear-end frame member. The belt 4 is turned over the belt-turnover bar 25 and is frictionally held in overlapped form by the engaging corner 26.

With the belt end fastener of this invention, following advantageous results can be achieved.

According to the first aspect of the invention, partly since the socket 2 is in the form of a flatted tube, and partly since the plug 3 has a plurality of belt-insertion holes 14 extending transversely in a plate-like tongue 12 and a belt-skid-prevention portion 15 extending at an edge of the belt-insertion holes 14, one end portion of the belt 4 can be fastened in a fixed posture neatly and firmly with no exposure and can be tentatively held so as to be inserted into the socket 2 smoothly, and the belt end fastener 1 can be exchanged with another in a simple manner while in use.

According to the second aspect of the invention, since the tongue 12 of the plug 3 is wedge-shaped at its front end so as to clamp the folded end portion of the belt 4 between the lower plate 9 of the socket 2 and the tongue 12, the plug 3 can be inserted into the socket 2 in a very simple manner with one end portion of the belt 4 tentatively held, and the belt end portion can be fastened stably and reliably with no skid.

According to the third aspect of the invention, since the plug 3 has at opposite sides a pair of resilient locking projections 19 engageable with the socket 2, the plug 3, with one end portion of the belt 4 tentatively held, can be fastened firmly in the socket 2 and does not come off unless removed intentionally. Also, the plug 3 can be inserted into the socket 2 in a simple manner and which can be exchanged with another simply.

According to the fourth aspect of the invention, since the plug 3 has a ring 21 projecting from the base 13, both inserting of the plug 3 into the socket 2 and adjusting the belt length can be performed by gripping the ring 21, thus fastening and unfastening the belt 4 smoothly and simply.

According to the fifth aspect of the invention, since the plug 3 has a belt-length adjuster 22 extending from the base, it is possible to widen the range of application of the belt end fastener.

According to the sixth aspect of the invention, since the belt end fastener 1 is a double form composed of male and female fasteners 1 having interengageable male and female coupling members 28,27, it is possible to widen the range of application of the belt end fastener.

According to the seventh aspect of the invention, since the socket 2 has at its plug-insertion mouth 5 a belt-length adjuster 7 projecting from opposite side walls, it is possible to adjust length a very simple manner.

According to the eighth aspect of the invention, since the socket 2 has at its plug-insertion mouth a grip ring 21 having in opposite inner edges a pair of tapered plug-guide ribs 35, fastening and unfastening the belt end portion can be done by gripping the ring 21, and the plug 3 with folded belt end portion tentatively held can be inserted into and removed from the socket 2 reliably in a simple manner.

According to the ninth aspect of the invention, partly since t:he socket 2 has on its opposite inner sides a pair of plug-guide ribs 35 on which opposite side frame of the plug 3 are slidable, and partly since the base 13 of the plug 3 is slidably received between the two plug-guide ribs 35, the plug 3 can be guided with respect to the socket 2 reliably and smoothly.

According to the tenth aspect of the invention, partly since the socket 2 has at its plug-insertion-mouth 5 a belt-length adjuster 22 projecting from opposite side walls 7, and partly since the belt-length adjuster 22 has on its opposite inner edges a pair of tapered plug-guide ribs 35, the belt length can be adjusted in a simple manner, and the plug 3 can be inserted into and removed from the socket 2 reliably and smoothly.

According to the eleventh aspect of the invention, since the socket 2 has a pair of attachment side projections 33 extending in opposite directions from the lower plate 9 of the socket 2, it is possible to attach the socket 2 to a rucksack, a shoulder bag, etc. in a simple manner.

What is claimed is:

1. A belt end fastener comprising:

(a) a flattened tubular socket having an upper plate, a lower plate and opposite side walls joined to the upper and lower plates and defining a plug-accommodation chamber; and (b) a plug to be detachably inserted in said socket, said plug having a plate-like tongue, a plurality of belt-insertion transverse holes through said plate-like tongue and a belt-skid-prevention portion extending at an edge of at least one of said belt-insertion transverse holes, said plate-like tongue and belt-insertion transverse holes contained between said upper and lower plates of said plug-accommodation chamber, said plug having at one end an enlarged base.

2. A belt end fastener according to claim 1, wherein said plug having at the other end a wedge-shape tongue for holding an end of a belt in a folded form when said plug is inserted in said socket.

3. A belt end fastener according to claim 1, wherein said plug having at opposite sides a pair of resilient locking projections for engagement with said socket.

4. A belt end fastener according to claim 1, wherein said plug having a ring projecting from said base.

5. A belt end fastener according to claim 1, wherein said plug has a belt-length adjuster connected to said base.

6. A belt end fastener according to claim 1, wherein said belt end fastener is in a double form in which a pair of belt end fasteners have interlocking male and female coupling members projecting from bases of the two plugs respective.

7. A belt end fastener according to claim 1, wherein said socket has on its plug-insertion end a ring extending from opposite side walls of said socket.

8. A belt end fastener according to claim 7, wherein said ring has on opposite inner edges a pair of tapered plug-guide ribs for guiding a plug.

9. A belt end fastener according to claim 8, wherein said plug has a frame having a pair of opposite side members slideable on said plug-guide ribs and said base of said plug is formed so as to be inserted between said plug-guide ribs.

10. A belt end fastener according to claim 1, wherein said socket has on its plug-insertion end a belt-length adjuster extending from opposite side walls of said socket and having on its opposite inner edges a pair of tapered plug-guide ribs.

11. A belt end fastener according to claim 1, wherein said socket has a pair of side attachment projections extending in opposite directions from its lower wall so that said socket is attachable to other articles.

12. A belt end fastener according to claim 1, wherein the plate-like tongue defines a recess at each one of opposed sides of the belt-skid-prevention portion.

13. A belt end fastener according to claim 1, wherein said plug-accommodation chamber has a plug-insertion mouth and a belt-insertion mouth at opposite ends of the plug-accommodation chamber.

14. A belt end fastener comprising:

a flatted tubular socket; and a plug to be detachably inserted in said socket, said plug having a plurality of belt-insertion transverse holes and a belt-skid-prevention portion extending at an edge of said belt-insertion transverse holes, said plug having at one end an enlarged base;

wherein said belt end fastener is in a double form in which a pair of belt end fasteners have interlocking male and female coupling members projecting from bases of the two plugs respective.

15. A belt end fastener comprising:

a flatted tubular socket; and a plug to be detachably inserted in said socket, said plug having a plurality of belt-insertion transverse holes and a belt-skid-prevention portion extending at an edge of said belt-insertion transverse holes, said plug having at one end an enlarged base;

wherein said socket has on its plug-insertion end a ring extending from opposite side walls of said socket; and wherein said ring has on opposite inner edges a pair of tapered plug-guide ribs for guiding a tapered plug.

16. A belt end fastener according to claim 15, wherein said plug has a frame having a pair of opposite side members slidable on said plug-guide ribs and said base of said plug is formed so as to be inserted between said plug-guide ribs.

17. A belt end fastener comprising:

a flatted tubular socket; and a plug to be detachably inserted in said socket, said plug having a plurality of belt-insertion transverse holes and a belt-skid-prevention portion extending at an edge of said belt-insertion transverse holes, said plug having at one end an enlarged base;

wherein said socket has on its plug-insertion end a belt-length adjuster extending from opposite side walls of said socket and having on its opposite inner edges a pair of tapered plug-guide ribs.

* * * * *